United States Patent [19]

Lau

[11] Patent Number: 4,526,733

[45] Date of Patent: Jul. 2, 1985

[54] MELTBLOWN DIE AND METHOD

[75] Inventor: Jark C. Lau, Roswell, Ga.

[73] Assignee: Kimberly-Clark Corporation, Neenah, Wis.

[21] Appl. No.: 442,486

[22] Filed: Nov. 17, 1982

[51] Int. Cl.[3] ..... B29F 3/04

[52] U.S. Cl. ..... 264/12; 264/518; 264/DIG. 75; 425/7; 425/72 S; 425/464

[58] Field of Search ..... 264/DIG. 75, 518, 12, 264/142; 425/72 S, 311, 7, 464

[56] References Cited

U.S. PATENT DOCUMENTS

| | | | |
|---|---|---|---|
| 2,571,457 | 10/1951 | Ladisch | 264/DIG. 75 |
| 3,516,120 | 6/1970 | Braun et al. | 425/311 |
| 3,676,242 | 7/1982 | Prentice | 156/62.4 |
| 3,755,527 | 8/1973 | Keller et al. | 264/210 |
| 3,825,379 | 7/1974 | Lohkamp et al. | 425/72 S |
| 3,825,380 | 7/1974 | Harding et al. | 425/72 |
| 3,849,241 | 11/1974 | Buntin et al. | 161/169 |
| 3,970,417 | 6/1976 | Page | 425/72 S |
| 3,978,185 | 8/1976 | Buntin et al. | 264/DIG. 75 |
| 4,048,364 | 9/1977 | Harding et al. | 264/DIG. 75 |
| 4,093,771 | 6/1978 | Goldstein et al. | 428/312 |
| 4,112,159 | 9/1978 | Pall | 428/36 |
| 4,185,981 | 1/1980 | Ohsato et al. | 264/12 |
| 4,211,736 | 7/1980 | Bradt | 264/12 |
| 4,221,753 | 9/1980 | Bradbury | 425/311 |
| 4,264,553 | 4/1981 | Loo | 264/142 |
| 4,340,563 | 7/1982 | Appel et al. | 264/518 |

FOREIGN PATENT DOCUMENTS

| | | | |
|---|---|---|---|
| 53-30928 | 3/1978 | Japan . | |
| 53-61772 | 6/1978 | Japan | 264/12 |
| 54-73916 | 6/1979 | Japan | 264/12 |
| 54-103466 | 8/1979 | Japan | 264/12 |
| 55-90663 | 7/1980 | Japan | 264/12 |

OTHER PUBLICATIONS

NRL Report 4364, "Manufacture of Super-Fine Organic Fibers", Wendt, V. A.; Boon, E. L.; and Fluharty, C. D.

NRL Report 5265, "An Improved Device for the Formation of Super-Fine Thermoplastic Fibers", Lawrence, K. D.; Lukao, R. T.; and Young, J. A.

*Primary Examiner*—James Lowe

*Attorney, Agent, or Firm*—William D. Herrick

[57] ABSTRACT

Improvement to the die and method of forming meltblown fibers and webs using a relatively cool fluid for meltblowing. Thermoplastic polymers such as polyolefins, polyamides, polyesters and the like are spun in accordance with the meltblowing process and contacted by a fluid which forms fibers and attenuates them. In accordance with the invention, the fluid is substantially cooler than the molten polymer and permits formation of webs at shorter forming distances greatly improving web formation. In addition, the costs of manufacture are improved since heating of the attenuating fluid may be reduced or avoided. In a particularly preferred embodiment, the die is provided with insulation between the attenuating fluid and the polymer chamber to avoid or reduce the tendency of the molten polymer to cool and cause plugging of the die. Alternatively, the die may, itself, be formed from an insulating material. Webs produced in accordance with the method and die of the present invention display highly desirable properties such as uniformity, softness, opacity, cover and the like.

15 Claims, 6 Drawing Figures

MELTBLOWN DIE AND METHOD

BACKGROUND OF THE INVENTION

1. Field of the Invention

The present invention relates to the formation of nonwoven webs from thermoplastic polymers. More particularly, it relates to webs formed by meltblowing. This process is used primarily to form thermoplastic microfibers and involves spinning a molten polymer and contacting it while molten with a fluid, usually air, directed so as to form filaments or fibers and attenuate them. After cooling, the fibers are collected and bonded to form an integrated web. Such webs of microfibers have found particular utility as filter materials, absorbent materials, moisture barriers, and insulators. In achieving high speed production of such materials, it is important that the polymer viscosity be maintained low enough to flow and prevent plugging of the die tip which will normally require that the polymer be heated. Further, high quality products and webs require that uniformity and strength properties be maintained at desired levels.

2. Description of the Prior Art

Early work in the formation of meltblown microfibers is described in various government publications relating to work done by the Naval Research Laboratory in Washington, D.C. Examples include NRL Report 4364 "Manufacture of Super-Fine Organic Fibers" by V. A. Wendt, E. L. Boon, and C. D. Fluharty; NRL Report 5265 "An Improved Device for the Formation of Super-Fine Thermoplastic Fibers" by K. D. Lawrence, R. T. Lukas, and J. A. Young. The process described uses an adjustable extruder to force a hot thermoplastic melt through a row of fine orifices into high velocity dual streams of heated gas, usually air. The nozzle design provides for immediate resumption of attenuation following breaks which occur at sub-micron dimensions. Through the control of air and nozzle temperatures, air pressure, and polymer feed rate, fiber diameters may be regulated. Preparation of fabrics from these fine fibers is also disclosed. Improvements to this process are described in many patents including, for example, U.S. Pat. No. 3,676,242 to Prentice issued July 11, 1972; U.S. Pat. No. 3,755,527 to Keller et al issued Aug. 28, 1973; U.S. Pat. No. 3,825,379 to Lohkamp et al issued July 23, 1974; U.S. Pat. No. 3,849,241 to Buntin et al issued Nov. 19, 1974; and U.S. Pat. No. 3,825,380 to Harding et al issued July 23, 1974. In all such disclosures it is contemplated that the molten polymer be attenuated by a stream of hot, inert fluid, usually air. Forming webs in such cases usually requires forming distances of at least about 12 inches to provide for fiber forming, cooling and attenuation. Such distances frequently result in undesirable non-uniformities in the web and its properties. At shorter forming distances a harsh, stiff web is often produced with a preponderance of "shot" or solid polymer globules.

It is also known to provide insulation on the outer surface of spinning dies to reduce heat loss into the surrounding environment. For example, U.S. Pat. No. 2,571,457 to Ladisch issued Oct. 16, 1951 discloses such an insulated die. It has, moreover, been suggested that in certain cases spun fibers may be contacted by cold gas to accelerate cooling and solidification. For example, U.S. Pat. No. 4,112,159 to Pall issued Sept. 5, 1978 contains such a disclosure. However, it remains a desired goal to improve the formation of meltblown nonwoven fabrics and to achieve further economies in processes and apparatus used to form such fabrics.

SUMMARY

The present invention results from the discovery that, contrary to teachings in the prior art, it is not necessary to employ a high temperature attenuating fluid in the meltblowing process. On the contrary, it has been found that use of such a fluid, usually air, having a temperature at least 100° F. cooler than the molten polymer is not only more economical but allows close forming distances producing much improved web formation and uniformity as well as attendant beneficial properties. In accordance with the invention, in the meltblowing process which comprises providing a molten polymer at low viscosity and extruding the polymer after which it is contacted by attenuating fluid streams at a velocity and in a direction such as to cause fibers to be formed and drawn to fine diameters, an attenuating fluid, usually air, is employed at a temperature well below that of the spun polymer. The result is that the polymer is cooled much more rapidly and may be collected at shorter distances from the die tip which avoids the formation of grosser non-uniformities and provides much improved web properties. The present invention, thus, avoids the need to heat large volumes of attenuating fluid and is, therefore, economical. Further, in a preferred embodiment, the die is provided with insulating means between the molten polymer and the cooler fluid flow which reduces the tendency of the polymer to solidify within the die. Alternatively, the die itself may be constructed from an insulating material achieving the same result. The method and die of the present invention are useful with a wide variety of thermoplastic polymers including polyolefins, polyesters, polyamides, and the like. In a particularly preferred embodiment, a recessed die tip as described in Japanese patent application 30928/78 filed Mar. 20, 1978 may be employed to further improve formation.

DESCRIPTION OF THE PREFERRED EMBODIMENTS

While the invention will be described in connection with preferred embodiments, it will be understood that it is not intended to limit the invention to those embodiments. On the contrary, it is intended to cover all alternatives, modifications and equivalents as may be included within the spirit and scope of the invention as defined by the appended claims.

Nonwoven webs manufactured by meltblowing thermoplastic polymers have achieved a substantial degree of commercial success. Thus, such materials are used alone or in combination as wipers, absorbent materials such as for catamenial devices, insulating materials, battery separators, and in health care and recreational fabric applications. In many of these applications as well as in others, the appearance of the web is an increasingly important factor. In addition, in applications where water barrier properties are important such as in recreational fabrics, it is essential that a uniform web be manufactured. Many applications also benefit from stronger webs for a given basis weight. Furthermore, it is always desirable to improve the economics of the web manufacturing process.

Conventional meltblowing processes rely on the contact of molten polymer with high temperature gas, usually air, to form fibers and draw them to very fine diameters. Because the air flow contacts the die structure, the use of this high temperature fluid has been considered essential to maintain low polymer viscosity permitting high production rates and to avoid solidification of polymer within the die or otherwise plugging the die tip and forcing interruptions in the web manufacture. However, for reasons not entirely clear, such high temperatures have frequently resulted in excessive "shot" in the webs when formed at short distances. In addition, it has been considered that heated fluid was necessary to avoid undue stress on the metal from which the die has been constructed.

Figure 1:
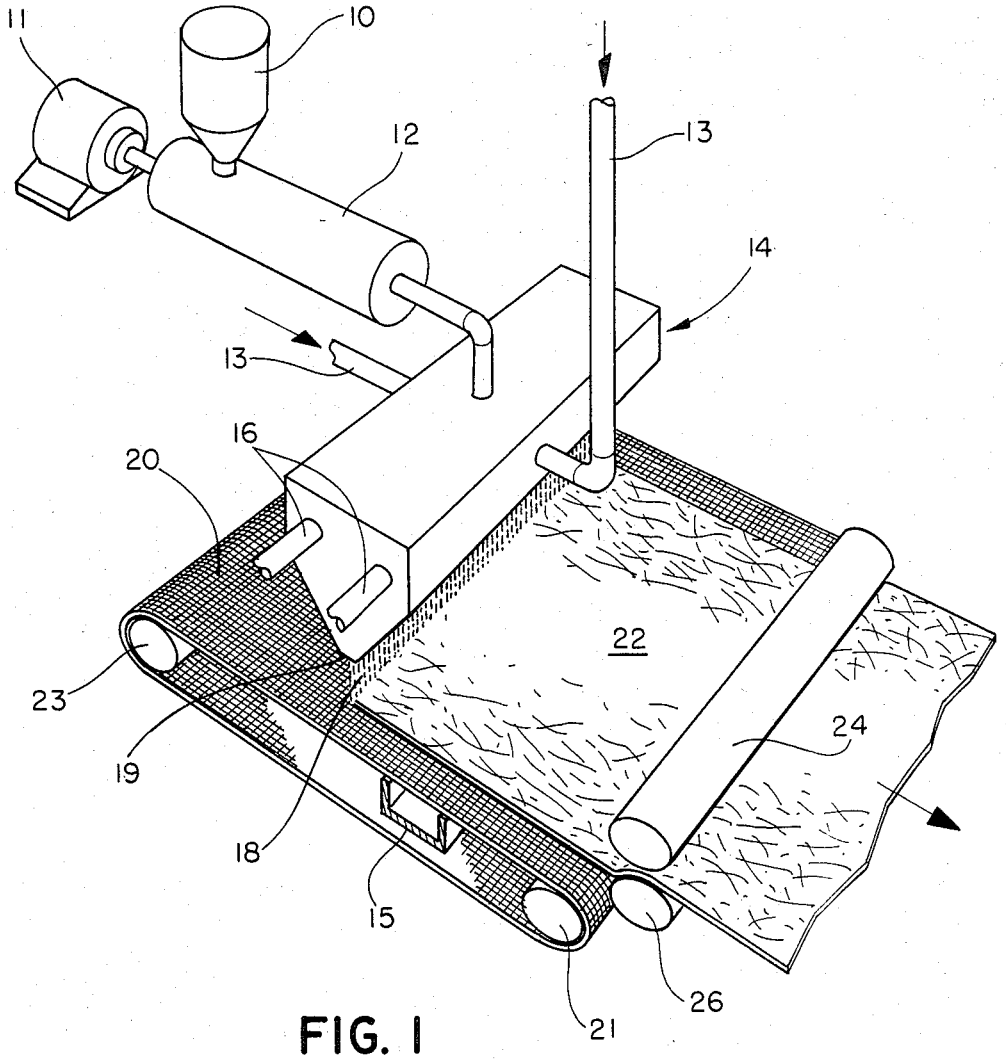
FIG. 1 is a schematic illustration of the process of the present invention from the extruder through web formation.

Turning to FIG. 1, the web formation process will be generally described. Hopper 10 provides polymer to extruder 12 which is driven by motor 11 and heated to bring the polymer to the desired temperature and viscosity. The molten polymer is provided to die 14 which is also heated by means of heater 16 and connected by conduits 13 to a source of attenuating fluid. At the exit 19 of die 14, fibers 18 are formed and collected with the aid of suction box 15 on foraminous belt 20 into web 22 which may be compacted or otherwise bonded by rolls 24 and 26. Belt 20 may be rotated by means of a driven roll which may be either 21 or 23, for example.

Figure 2:
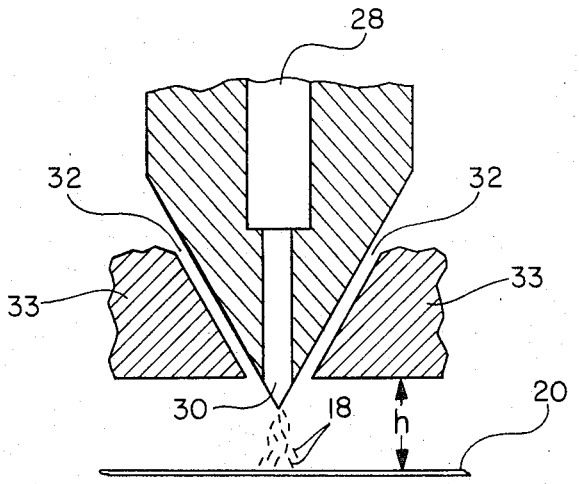
FIG. 2 is an enlarged cross-section view of a prior art die tip useful in accordance with the method of the invention.

Turning to FIG. 2, an existing die tip design will be described in greater detail. As shown, polymer enters at 28 and exits through orifice 30. At the exit, it is contacted on two sides by streams of fluid through channels 32 in support 33 which cause the polymer stream to attenuate and fracture into drawn fibers 18. As these fibers are drawn, in most cases they will tend to break forming fine fibers of an average of less than about 10 microns in diameter and widely varying lengths in the range generally of at least about 5 millimeters. The distance "h" represents the forming distance from the exit of the die to the fiber collecting belt 20 or other forming surface. As discussed above, in most cases it has been believed that this distance must be on the order of at least about 8 to 12 inches to permit sufficient quenching or cooling of the fibers. In accordance with the present invention, however, the attenuating fluid is provided at a temperature at least about 100° F. less than that of the molten polymer and preferably at the lowest temperature of the available fluid without artificial cooling. The fibers are rapidly quenched permitting a forming distance "h" of less than 8 inches and preferably 6 inches or less. In this embodiment the die design is otherwise generally in accordance with the above-described U.S. Pat. No. 3,825,380 to Harding et al issued July 23, 1974.

Figure 3:
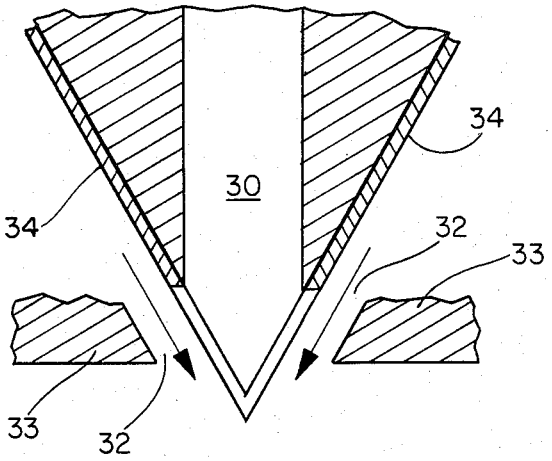
FIG. 3 is a view similar to FIG. 2 wherein the die tip is insulated in accordance with one aspect of the present invention.

Turning to FIG. 3, a similar die tip arrangement is illustrated except that insulation layer 34 is provided on the die tip surface between the hot die tip and the cooler attenuating fluid. This insulating material may be any of a number of compositions that will withstand high polymer melt temperatures and other operating conditions including contact with the cooler attenuating fluid. Examples include silicon based ceramics such as fused, porous silica borosilicate. Others are described in U.S. Pat. No. 4,093,771 to Goldstein et al issued June 6, 1978. Such compositions may be coated or otherwise bonded to the surface with high temperature adhesive such as CERAMABOND TM which is available from Aremco Products, Inc.

Figure 4:
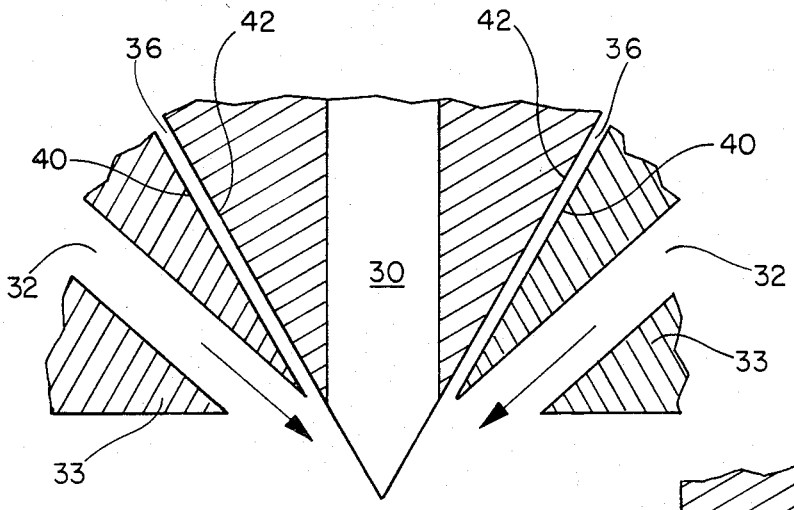
FIG. 4 is a view like that of FIG. 3 showing an alternative air gap insulating means.

Turning to FIG. 4, an alternative die tip structure is illustrated wherein the insulation is an air gap layer 36 between surfaces 40 and 42. This structure has the advantage that air is an exceptionally good insulator. On the other hand, it may require more expensive machining and construction.

Figure 5:
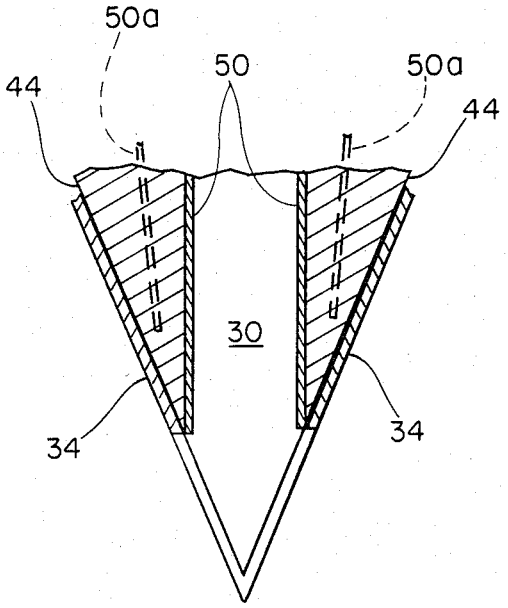
FIG. 5 is a cross-sectional view of a die tip using strip heaters to maintain the elevated polymer temperature.

Turning to FIG. 5, a third alternative construction is illustrated wherein heater strips 50 are used to keep the polymer hot while the outer surface 44 is insulated by layer 34. Alternatively, the heating strips **50*a*** may be within the die body.

Figure 6:
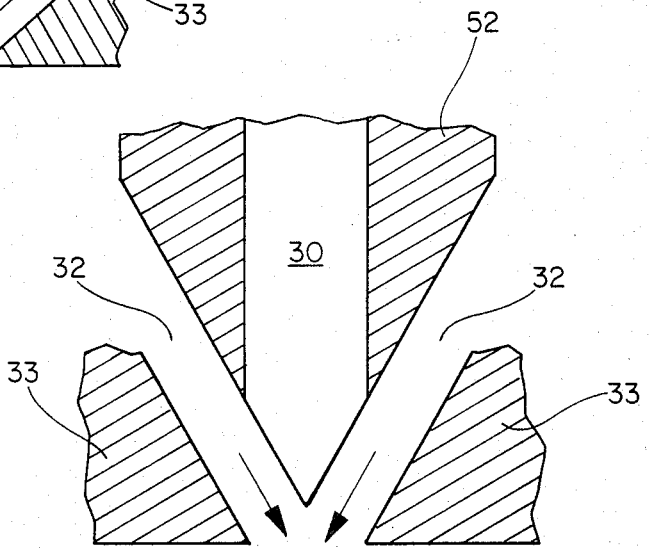
FIG. 6 is a preferred die tip arrangement embodying a recessed structure as in Japanese No. 30928/78 in the method of the invention.

FIG. 6 illustrates in cross-section a prior art die tip recessed so as not to protrude through the support opening that may be employed in accordance with the method of the present invention.

Another alternative (not shown) is to construct the entire die as in FIG. 2 but out of insulating material.

The selection of a particular attenuating fluid will depend on the polymer being extruded and other factors such as cost. In most cases it is contemplated that available air from a compressor may be used as the attenuating fluid. In some cases it may be necessary to cool the air in order to maintain the desired temperature differential. In all cases, however, it is essential that the desired minimum temperature differential be maintained in order to permit the reduced forming distances and obtain the above described advantages. Other available inert gases may be used for attenuating in exceptional cases.

The die, itself, may be manufactured from materials conventionally used for manufacturing dies such as stainless steel. In alternative embodiments, the die is manufactured from insulating materials as above described. The die may be constructed of one piece or may be of multi-piece construction, and the die openings may be drilled or otherwise formed. For particulars as to die tip construction, reference may be had to U.S. Pat. No. 3,825,380 to Harding et al issued July 23, 1974 which is incorporated herein by reference.

The insulating material used to protect the molten polymer from the cool attenuating fluid in accordance with the invention may be selected from those materials which may be applied or attached to the die tip in the desired manner and yet withstand the conditions of extrusion. For example, materials such as porous silica borosilicate may be used. The thickness of the insulating layer will depend upon the properties of the insulating material as well as the space available but generally will be at least about 0.5 millimeter and preferably at least 1 millimeter. When such insulating materials are used, lower polymer temperatures may be employed without increasing the danger of polymer solidification within the die. Conversely, when insulating material is not used, increasing the temperature of the polymer or otherwise lowering the polymer viscosity will reduce the incidence of polymer solidification within the die.

The polymer, itself, as will be recognized by those skilled in this art, may be selected from a wide variety of thermoplastic materials. Such materials may be a single polymer or blends of polymers and may contain additives such as prodegradents, dyes, fillers, or the like. Examples of polymers include polyolefins such as polypropylene and polyethylene, polyamides, polyesters and acrylic polymers.

EXAMPLES

Example 1

Apparatus as schematically illustrated in FIG. 2 was assembled. Polypropylene resin was brought to a melt temperature of 511° F. and extruded at a rate of 3 g/min per hole to form microfibers. This is equivalent to a throughput rate of 12 lb. per inch per hour in a conventional die of 30 holes per inch. The die tip had 1 hole of a diameter of 0.0145 inch. In this case, air was used as the attenuating fluid and heated to a temperature of 600° F. The plenum air pressure was 15 psi. The fibers were collected at a distance of 12 inches. The fibers had an average surface area of 0.7257 $m^2/g$ which indicates the degree of fiber fineness obtained. Attempts to reduce the forming distance resulted in excessive "shot".

Example 2

Example 1 was repeated except that the air temperature was reduced to 150° F. and the polymer heated to achieve the same viscosity. The forming distance was reduced to 6 inches. The web formation was noticeably improved and the web was free of "shot". The fibers had an average surface area of 0.9538 $m^2/g$ suggesting a smaller average denier of the fibers.

Example 3

Example 2 was repeated except that the forming distance was reduced to 4 inches. A very uniform web was achieved with minimal evidence of "shot".

Thus it is apparent that there has been provided in accordance with the invention an improved meltblowing die tip and method that fully satisfy the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. In a method of forming a nonwoven web comprising the steps of:

(a) providing a molten thermoplastic polymer, (b) spinning said molten polymer through one or more die tip orifices, (c) contacting said spun polymer while hot as it exits said die tip orifice or orifices with a fluid stream to form filaments and attenuate said filaments into microfibers having an average diameter in the range of up to about 10 microns, (d) collecting said drawn filaments, and (e) bonding said filaments to form an integrated web, the improvement wherein said fluid stream is provided at about the lowest temperature of available fluid without significant artificial cooling when contacting the polymer, said low temperature fluid stream is insulated from said molten polymer at the die tip, and the forming distance is about 8 inches or less.

2. The method of claim 1 wherein said thermoplastic polymer is polypropylene.

3. The method of claim 1 wherein said insulation is in the form of an air gap.

4. The method of claim 1 wherein said insulation is a material bonded to the die between said fluid stream and said molten thermoplastic polymer.

5. The method of claim 4 wherein said insulation material is a porous silica borosilicate.

6. The method of claim 1 including the additional step of heating said polymer within said die tip.

7. Apparatus for forming meltblown filaments comprising, (a) means for receiving a molten polymer, (b) a die communicating with said receiving means through a chamber to one or more die tip orifices through which said molten polymer may be spun, (c) fluid supply means adjacent said orifice for directing a fluid at about the lowest temperature of available fluid without artificial cooling against said spun polymer as it exits said die tip orifice or orifices to form filaments and attenuate said filaments into microfibers having an average diameter in the range of up to about 10 microns, (d) insulation between said chamber and said fluid supply means at said die tip, and (e) means for collecting said filaments at a distance of about 8 inches or less from said die tip.

8. The apparatus of claim 7 wherein said insulation is provided by an air gap.

9. The apparatus of claim 7 wherein said insulation is a silicon based ceramic material having a thickness of at least about 0.5 millimeter and bonded to the die tip between said orifice and said fluid supply.

10. The apparatus of claim 9 wherein said insulation material is a porous silica borosilicate bonded by means of a heat resistant adhesive.

11. The apparatus of claim 7 wherein the insulation comprises the material from which the die is formed.

12. The apparatus of claim 7 further including means for heating said polymer within said die tip.

13. The apparatus of claim 11 wherein said heating means is located within said die tip body.

14. The apparatus of claim 7 wherein said die tip is recessed.

15. The apparatus of claim 7 further including means for collecting said filaments at a distance of 6 inches or less from said die tip.

* * * * *